US009854860B1

(12) United States Patent
Katz

(10) Patent No.: US 9,854,860 B1
(45) Date of Patent: Jan. 2, 2018

(54) KNOT FORMATION DEVICE

(71) Applicant: Maxwell Katz, Lawrence, NY (US)

(72) Inventor: Maxwell Katz, Lawrence, NY (US)

( * ) Notice: Subject to any disclaimer, the term of this patent is extended or adjusted under 35 U.S.C. 154(b) by 0 days.

(21) Appl. No.: 15/365,486

(22) Filed: Nov. 30, 2016

(51) Int. Cl.
*A41D 25/08* (2006.01)
*A41D 25/10* (2006.01)

(52) U.S. Cl.
CPC ..... *A41D 25/08* (2013.01); *A41D 25/10* (2013.01)

(58) Field of Classification Search
CPC ..... A41D 25/08; A41D 25/10; A41D 25/14
See application file for complete search history.

(56) References Cited

U.S. PATENT DOCUMENTS 390,571 A * 10/1888 Currie ..... A47G 25/76 211/32
525,770 A * 9/1894 Parker ..... F16G 11/00 24/129 R
782,657 A * 2/1905 Hubert ..... F16G 11/00 24/131 C
1,073,226 A * 9/1913 Freeman ..... A01K 1/04 24/115 R
1,367,461 A * 2/1921 Caumont ..... A41D 25/025 2/153
1,375,119 A * 4/1921 Stephen ..... F16G 11/14 24/129 C
1,408,151 A * 2/1922 Waluch ..... A41D 25/025 2/153
1,458,066 A * 6/1923 Le Compte ..... A47G 25/485 223/111
1,599,040 A * 9/1926 Clisby ..... F16G 11/14 24/129 C
1,711,580 A * 5/1929 Binnemann ..... A41D 25/14 2/153
1,716,880 A * 6/1929 Ebling ..... A41D 25/14 2/153
2,174,478 A * 9/1939 Pugh ..... A41D 25/14 2/153
2,516,429 A * 7/1950 Skivenes ..... A41D 25/14 2/153
2,624,883 A * 1/1953 Rees ..... A41D 25/08 2/157
2,733,447 A * 2/1956 Furiyama ..... A41D 25/025 2/153
2,775,768 A * 1/1957 Stern ..... A41D 25/08 2/151
2,958,870 A * 11/1960 Johnson ..... A41D 25/14 2/153

(Continued)

*Primary Examiner* — Shaun R Hurley

(57) ABSTRACT

In one embodiment, the device includes a first contoured portion, a second contoured portion, a nose, a hoop, and an ornamental extension, a first end of the first contoured portion and a first end of the second contoured portion being continuous with the nose, a second end of the first contoured portion and a second end of the second contoured portion being continuous with the hoop, the ornamental extension extending from the nose, the first contoured portion configured for receiving a first portion of a tie, the second contoured portion configured for receiving a second portion of the tie, the nose configured to buttress a third portion of the tie, the hoop configured to buttress a fourth portion of the tie, the ornamental extension configured to descend between two portions of the tie.

20 Claims, 9 Drawing Sheets

(56) References Cited

U.S. PATENT DOCUMENTS 2,972,749 A * 2/1961 Gruber ..... A41D 25/14 2/153
3,069,739 A * 12/1962 Jorgenson ..... F16G 11/14 24/129 R
3,296,670 A * 1/1967 Burnett ..... F16G 11/14 24/131 R
3,438,098 A * 4/1969 Grabner ..... F16G 11/12 24/131 R
3,752,374 A * 8/1973 Pro ..... A41D 25/08 223/111
4,246,658 A * 1/1981 Liaw ..... A41D 25/14 2/152.1
5,562,456 A * 10/1996 Cianciotto ..... G09B 19/0076 289/17
5,577,299 A * 11/1996 Thompson ..... F16G 11/14 24/115 H
5,584,075 A * 12/1996 Bae ..... A41D 25/025 2/144
5,692,241 A * 12/1997 Helfer ..... A41D 25/08 2/148
5,983,461 A * 11/1999 Chen ..... A41D 25/025 24/115 H
6,015,172 A * 1/2000 Williams ..... A41D 25/08 223/DIG. 1
6,120,068 A * 9/2000 DiPietro ..... A41D 25/08 223/111
D438,782 S * 3/2001 Kalat ..... D8/370
7,270,291 B2 * 9/2007 Von Seidel ..... A47G 1/18 24/269
D552,980 S * 10/2007 Svedberg ..... D8/395
7,585,004 B1 * 9/2009 Page ..... A41D 25/025 289/17
8,047,580 B2 * 11/2011 Fay ..... A41D 25/14 289/17
8,128,133 B2 * 3/2012 Biancamano ..... A41D 25/14 289/17
D754,417 S * 4/2016 Hunter ..... D2/607
2008/0084066 A1 * 4/2008 Palos ..... A41D 25/08 289/18.1
2009/0256358 A1 * 10/2009 Fay ..... D04G 5/00 289/1.2
2010/0218553 A1 * 9/2010 Ricahrdson ..... A44C 7/00 63/14.1
2010/0327580 A1 * 12/2010 Biancamano ..... A41D 25/14 289/1.5
2011/0061151 A1 * 3/2011 Chang ..... A41D 13/11 2/424
2012/0055822 A1 * 3/2012 Bullock ..... A45C 11/00 206/320
2012/0324765 A1 * 12/2012 Tafoya ..... A43B 3/02 36/2 R
2013/0161378 A1 * 6/2013 Nebeker ..... B65D 33/065 229/116.5

* cited by examiner

KNOT FORMATION DEVICE

FIELD OF INVENTION

The present invention relates to a device for a necktie, and more particularly, to a necktie attachment for perfecting a necktie knot.

BACKGROUND

Neckties have been an important fashion accessory for individuals, both men and women, for a number of centuries. In modern times, neckties are often worn to signify business or formal attire, or as part of a uniform.

Often worn by men, the necktie is usually worn over a collared shirt, resting between the collar points.

A variety of knot styles may be used to tie the necktie into a knot, which often results in a pinch or dimple being formed in a longitudinal section of the tie, under the knot.

Knotting the tie is often performed by hand, and is subject to human variation, and as a result, often results in human error. Therefore, the pinch formed under the tie knot can be formed in a sloppy, unprofessional manner, which may detract from the elegance and formality of the necktie.

It would be desirable, therefore, to provide a necktie accessory that allows an individual to easily and consistently tie a necktie.

It would be further desirable to provide an easy-to-use necktie accessory in order to perfect the pinch/dimple of a necktie in a predictable fashion.

SUMMARY AND OBJECTS OF THE INVENTION

In accordance with the invention, provided herein is an inventive necktie device, attachment, or insert. The device includes a first contoured portion, a second contoured portion, a nose, and a hoop. The device may optionally include an ornamental extension. The first contoured portion may include a first end, and the second contoured portion may include a first end. The first end of the first contoured portion may be continuous with the nose, and the first end of the second contoured portion may be continuous with the nose.

The first contoured portion may include a second end. The second contoured portion may include a second end. The second end of the first contoured portion and the second end of the second contoured portion may be continuous with the hoop.

It is an object of the present invention to provide a removable necktie device for perfecting the knot of a necktie.

It is a further object of the present to provide an optional accessory to clip on or otherwise attach to the necktie device.

It is yet a further object of the present invention to provide a necktie with the removable necktie device.

It is yet a further object of the invention to provide the necktie device integral to the necktie.

DETAILED DESCRIPTION OF THE INVENTION

Figure 1:
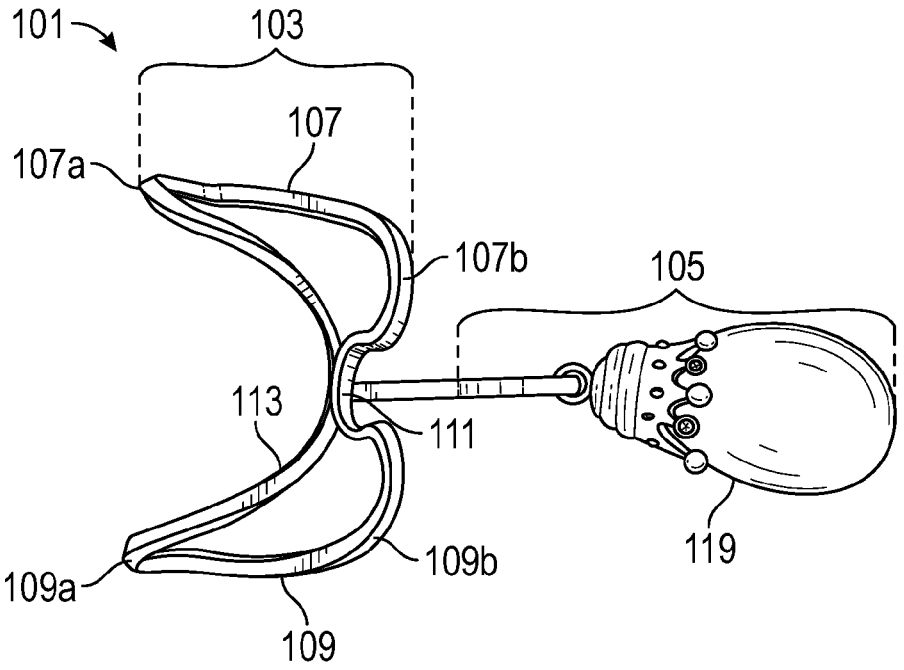
FIG. 1 is a front view of a first embodiment of the inventive necktie device.

In accordance with the invention a necktie device, insert or attachment (hereinafter, referred to as the "device" or the "inventive device") is provided. The device may be formed from any suitable insert, attachment, clip, or retaining device or any other suitable device.

It should be noted that, in accordance with the invention, the device may be utilized with a necktie, or any other suitable type of knotted fashion accessory, including, but not limited to, a bow tie, ascot, cravat, clip on, or any other piece of cloth desirable to pinch. Additionally, the device may be utilized with any product or accessory where it is desirable to form a pinch or cinch in material, or where it is desirable to form a symmetrical knot. As discussed herein, the use of the term "tie" or "necktie" is illustrative, and meant to include the use of the aforementioned accessories or devices, unless specifically limited otherwise.

The device may include one or more of a first contoured portion, a second contoured portion, a nose, and a hoop. The device may further include an ornamental extension projecting therefrom.

The first contoured portion may include a first end. The second contoured portion may include a first end. The first end of the first contoured portion may be continuous with the nose. The first end of the second contoured portion may be continuous with the nose.

The first contoured portion may include a second end. The second contoured portion may include a second end. The second end of the first contoured portion may be continuous with the hoop. The second end of the second contoured portion may be continuous with the hoop.

The first contoured portion may be configured to contact a portion of a necktie.

The device may include an ornamental extension. The ornamental extension may extend from the nose. For example, one or more ornamental extensions may removably engage the nose. In a further example, one or more ornamental extensions may be permanently engaged with the nose.

The necktie may include a plurality of segments. The necktie may include a first segment. The necktie may include a second segment. The necktie may include a third segment. The necktie may include a fourth segment. It should be noted that, in accordance with the invention, the segments may be contiguous with one another, and may be identical in appearance.

The first contoured portion may be configured to receive the first segment of the necktie. The second contoured portion may be configured to receive the second segment of the necktie.

The nose may be attached or buttressed to the third segment of the necktie. The hoop may be attached or buttressed to the fourth segment of the necktie.

The ornamental extension may be configured to slip or hang between two portions of the tie.

In an exemplary process, an untied necktie is provided. The device may be placed onto the necktie. In one embodiment, the device may be attached clipped across the entire width of the necktie, prior to knotting the tie. In another embodiment, the device may merely be placed upon the surface of the necktie.

It should be noted that the inventive device may be placed onto the necktie prior to beginning the tying process. Alternatively, the inventive device may be clipped across the width of the necktie after the beginning the neck-tying process, but immediately before the step of pulling the front piece of the necktie through the loose knot. By clipping the device on immediately prior to tightening the knot, the device will end up in the right place.

In an exemplary embodiment, the device is placed onto a mid-portion of the necktie, grasping a longitudinal segment of the necktie located immediately underneath a loosened portion of the knot.

In one embodiment, the device includes a first contoured portion, a second contoured portion, a nose, a hoop, and an ornamental extension, a first end of the first contoured portion and a first end of the second contoured portion being continuous with the nose, a second end of the first contoured portion and a second end of the second contoured portion being continuous with the hoop, the ornamental extension extending from the nose, the first contoured portion configured for receiving a first portion of a tie, the second contoured portion configured for receiving a second portion of the tie, the nose configured to buttress a third portion of the tie, the hoop configured to buttress a fourth portion of the tie, the ornamental extension configured to descend between two portions of the tie.

In one embodiment, the ornamental extension features a bauble. In another embodiment, the device does not feature an ornamental extension, instead, the nose terminates and is configured to be completely hidden between two portions of the tie.

In accordance with the invention, the device may be inserted on top of a portion of the necktie fabric, and may be secured to the necktie. For example, the device may be inserted once a loose knot is formed, or merely on a bottom portion of the necktie, before beginning to form or tie a knot. In one embodiment, the device may be secured merely by tightening the knot of the necktie, thereby causing the interior of the knot to form flush against the device. The device in this sense functions as a scaffold, preventing the tie knot from being overtightened. In another embodiment, the device may be secured by a plurality of clips or hinges, which may be placed on the edges of the device. These clips or hinges, and the device as a whole, is configured to work with all fabrics and neckties.

One advantage of the device is that its placement under the tie knot provides for hiding it from sight, with the exception of the ornamental piece. A further advantage is that the material of the device can be durable, without regard for its aesthetic, due to its hidden location. Yet a further advantage is that the device, to the extent it causes damage or wear, will only do so interior portions of a necktie, and not to a portion of the necktie viewed by others.

Referring now to the invention in more detail, FIG. 1 illustrates a front view of the inventive necktie device 101. Device 101 includes a main body 103. Device 103 may include an ornamental portion 105.

Main body 103 may be formed in any suitable shape. In one embodiment, main body 103 is formed in a bent shape, that is, in a substantially U-shape. This shape is specifically formed to allow the device 101 to self-secure to the interior a necktie knot. Furthermore, in accordance with the invention, the U-shape is specially formed to engage with the material of the necktie in the vicinity of the knotted portion to provide a dimple or other suitable aesthetically pleasing geometric feature.

In another embodiment, the main body 103 may be formed in any suitable shape, such as a circle or rectangle. In yet another embodiment, the main body 103 may be secured to the necktie via additional components, such as a pin or hinge, and therefore, may not need to be formed in a self-securing shape.

Main body 103 may include two side portions. In one embodiment, the two side portions are formed in a specifically contoured shape to allow the device 101 to maintain the shape of the necktie knot and/or self-secure the device 101 to the tie. In another embodiment, the two side portions may be formed in a general shape, such as a straight line, and may be secured by additional features.

As shown in FIG. 1, main body 101 includes first contoured side portion 107 and second contoured side portion 109.

First contoured side portion 107 includes a first end 107*a* and a second end 107*b*. Second contoured side portion 109 includes a first end 109*a* and a second end 109*b*.

The first end 107*a* of first contoured side portion 107, and the first end 109*a* of the second contoured portion, are continuous with nose 111. In accordance with the invention, the nose 111 of device 101 may function to retain the ornamental portion 105.

In one embodiment, the nose 111 is specifically formed in the center, or substantially the center, midway between the first contoured portion and the second contoured portion. More specifically, the nose 111 may be formed at a midpoint between the first end of the first contoured portion and the first end of the second contoured portion.

In an embodiment, nose 111 is formed in a substantially semi-circular shape. The semi-circular shape is formed so as to provide sufficient force to retain the device 101 within a necktie.

The second end 107*b* of the first contoured side portion 107 and the second end 109*b* of the second contoured side portion are integral with their respective side portions, which are in turn integral with the respective first ends.

Figure 2:
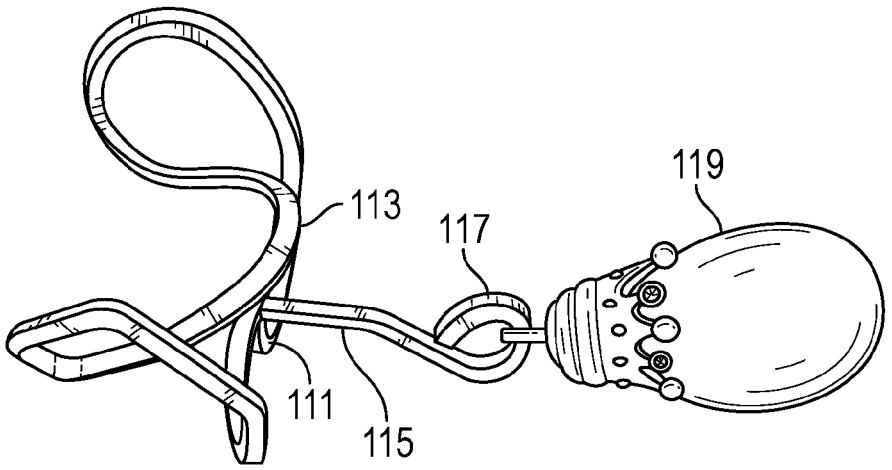
FIG. 2 is a side view of the first embodiment of the invention.

Second end 107*b* and second end 109*b* are formed continuous with hoop 113. Referring now to FIG. 2, illustrated is the wide-bowled semi-circular shape of hoop 113. It should be noted that the invention contemplates the use of varying shapes for hoop 113, including, but not limited to, narrower semi-circular shapes as well as additional shapes and sizes.

In one embodiment, hoop 113 may be the rear of device 101, and may thus reside toward the back of the necktie. Further, nose 111 may be located toward the front of the device 101. In another embodiment, the hoop 113 may be placed toward the front of the device 101.

Figure 3:
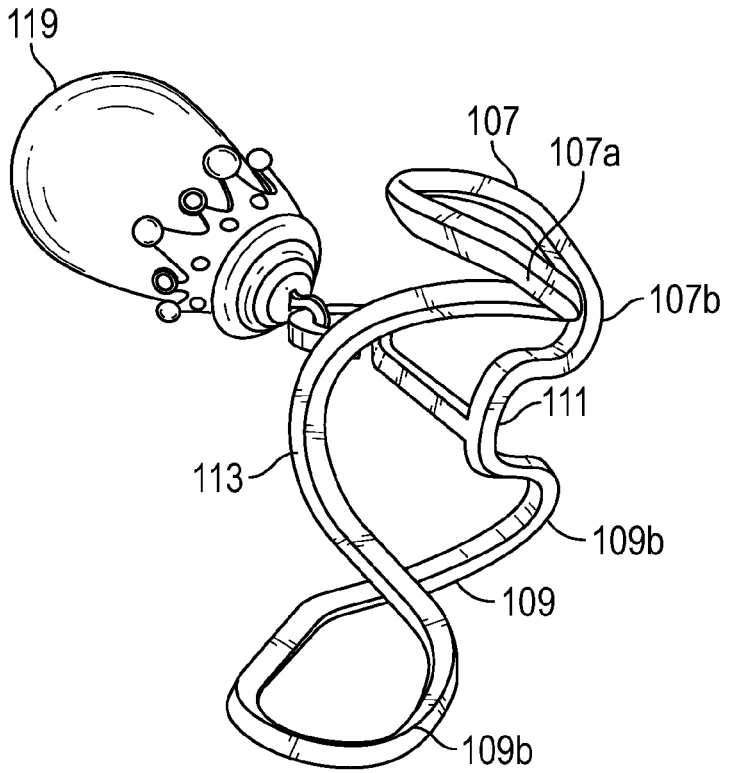
FIG. 3 is a rear perspective view of the first embodiment of the invention.

In reference now to FIG. 3, the device 101 is shown from a rear perspective view. As illustrated, the hoop 113 may be elevated relative to the remainder of the device 101. When laid flat upon a necktie, the hoop 113 may be placed higher up on the necktie relative to the remainder of the device 101, and may anchor the entirety of the device 101 by applying force and/or pressure to the surface of the necktie upon which it lies.

Referring again to FIG. 2, ornamental portion 105 includes an extension 115 descending downward from nose 111. Extension 115 may be formed in unitary construction with the nose 111. Alternatively, extension 115 may be attached to the nose 111, such as, for example, by welding or adhesive.

In one embodiment, extension 115 may terminate in a ring 117. Ring 117 may be configured to hold a bauble 119. Bauble 119 may be any suitable ornamental object or design.

In another embodiment, extension 115 may terminate directly into bauble 119. Thus, extension 115 may be substantially rectangular in shape, and may not contain a hoop.

Figure 4:
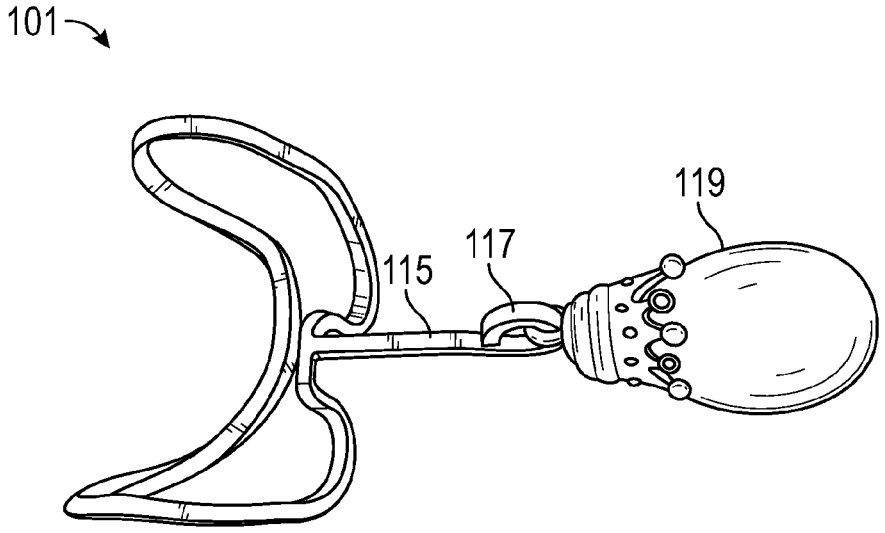
FIG. 4 is another side of the first embodiment of the invention.

As illustrated in FIG. 4, ornamental bauble 119 is suspended from the remainder of device 101, such that the bauble, and in some instances, a portion of the extension 115 and/or ring 117, is capable of protruding on an outside surface, while the rest of device 101 remains hidden within the necktie.

Figure 5:
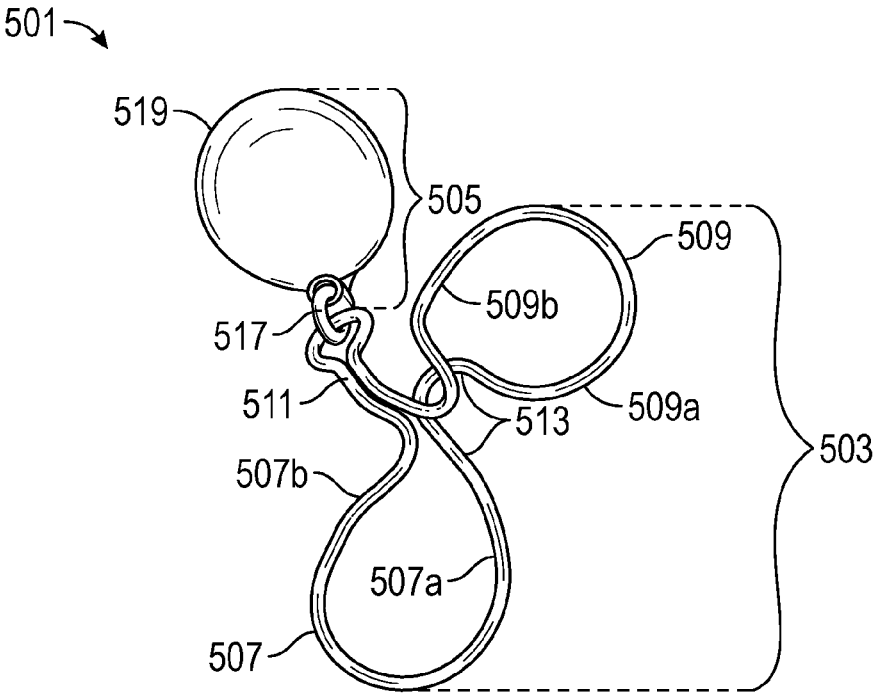
FIGS. 5-6 illustrate a second embodiment of the invention.
Figure 6:
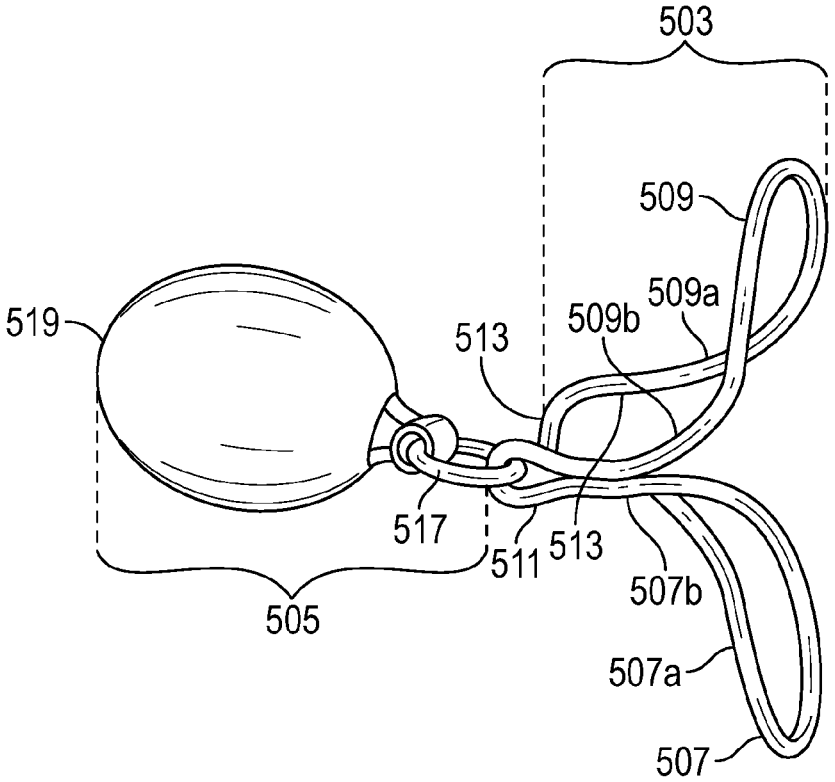

In reference to FIGS. 5 and 6, illustrated is an alternative embodiment of the invention. In this embodiment, device 501 may include some or most of the features of device 101.

Device 501 includes a main body 503 and an ornamental portion 505. Main body 503 includes a first contoured side portion 507, with a first end 507*a* and a second end 507*b*. Main body 503 further includes a second contoured side 509, with a first end 509*a* and a second end 509*b*.

Device 501 further includes nose 511. Nose 511 may be formed midway between the first contoured side portion 507 and the second contoured side portion 509. Nose 511 may be formed continuous with first contoured side portion 507 and second contoured side portion 509.

In one embodiment, nose 511 is formed in a narrow U-shape. Nose 511 may narrow is it descends, causing the two sidewalls to come into contact with one another. Nose 511 may then widen at the bottom, forming a ring shape. The ring shape may be adapted to receive an ornamental bauble 519. Ornamental bauble 519 may include an attachment apparatus 517. Apparatus 517 may be formed integral with bauble 519, or may be a separately formed piece that attaches to both bauble 519 and nose 511.

In one embodiment, apparatus 517 may releasably engage one or both of nose 511 and bauble 519. In doing so, the bauble 519 may be removed and replaced with a different bauble of an alternative design.

Device 501 may further include hoop 513. Hoop 513 may be formed continuous and integral with second end 507*b* and second end 509*b*.

As disclosed herein, uses and features of device 501 may be incorporated into device 101, and uses and features of device 101 may be incorporated into device 501.

Figure 7:
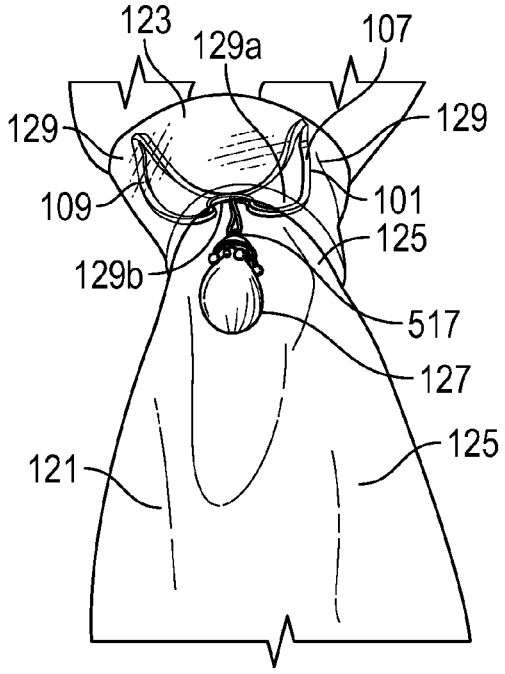
FIGS. 7-8 illustrate use of the invention.

Referring now to FIG. 7, in accordance with the invention, the device 101 may be used with necktie 121. As illustrated, a top portion 123 of the necktie, representing a front segment of the knotted portion 129, covers and contains the device 101. A bottom portion 125 of the necktie, forming a rear segment of the knotted portion 129 and extending outward from the knotted portion 129, contains the device 101 in conjunction with top portion 123.

Bottom portion 125 further includes dimple or pinch 127. In accordance with the invention, the use of device 101 within the knotted portion 129, that is, between the top portion 123 and the bottom portion 125, is configured to form a symmetrical and aesthetically pleasing dimple 127. Additionally, in some embodiments, the ornamental bauble 119 may protrude downward from within the knotted portion 129. The ornamental bauble 119 may reside within at least a portion of the pinch 127.

Figure 8:
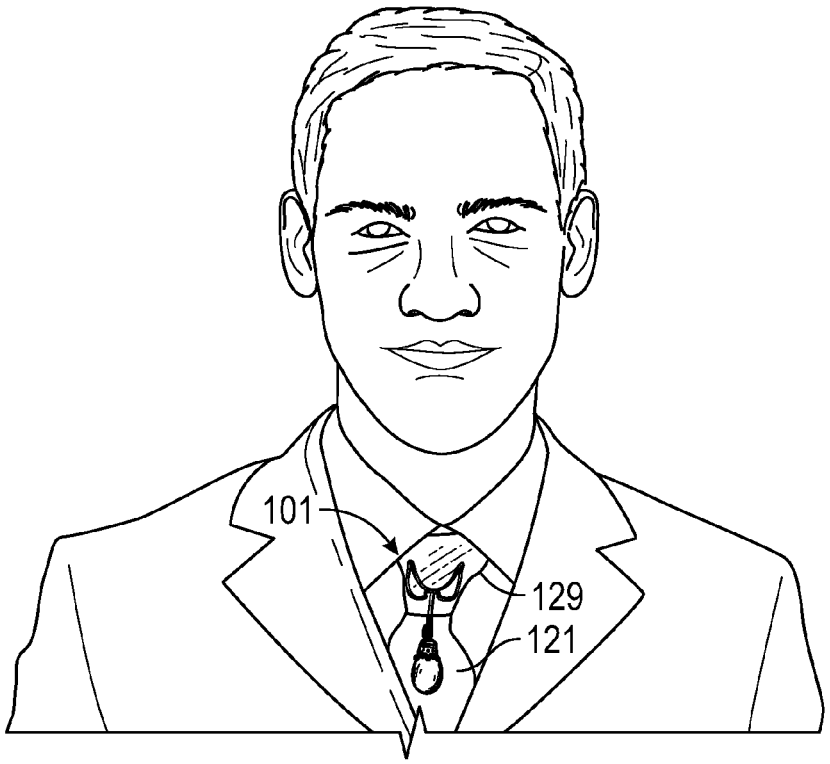

As shown in FIG. 8, the device 101 may be utilized with a necktie 121 in accordance with the invention. The necktie 121 may be worn in any suitable fashion, with the device 101 residing within the knotted portion 129.

Referring back to FIG. 7, the first contoured side portion 107 and second contoured side portion 109 are configured to engage the interior sidewalls of the knotted portion 129 of necktie 121. Thus, in accordance with the invention, necktie 121 forms a loose knotted portion 129, and then receives the device 101 within the interior of the knotted portion 129.

As the knotted portion 129 is tightened to form a proper knot, the side portion 107 and side portion 109 of the device 101 come into contact with the interior of the knotted portion and form a tight knot, as well as secure to the necktie 121. Additionally, nose 111 causes a deformation to form within the bottom portion 125 at an area around the bottom of the knotted portion. More specifically, the rear of nose 111 may cause the deformation. The deformation of the bottom portion 125 forms a dimple 127.

In accordance with the invention, the dimple 127 is formed in a predictable and symmetrical shape as a result of the nose 111 forming a symmetrical deformation.

Thus, the first contoured portion 107 receive a first portion of the necktie 121, that is, one interior sidewall of the knotted portion 129. The second contoured portion 109 receives a second portion of the necktie 121, such as a second interior sidewall of the knotted portion 129.

The nose 111 engages and buttresses a third portion of the necktie, such as any suitable location on the bottom portion 125. The hoop 113 engages and buttresses a fourth portion of the necktie 121. Thus, hoop 113 engages an area such as the bottom portion 125, but at a position toward the top of the knotted portion 129.

The ornamental extension 115 may be configured to descend into the dimple 127.

In one embodiment, the knotted portion 129 may include a top portion 129*a* and a bottom portion 129*b*. The bottom portion 129*b* may form a part of the bottom portion 125 of necktie 121. In this embodiment, the ornamental extension 115 may be configured to slip between the top portion 129*a* and the bottom portion 129*b* of the necktie 121.

Figure 9:
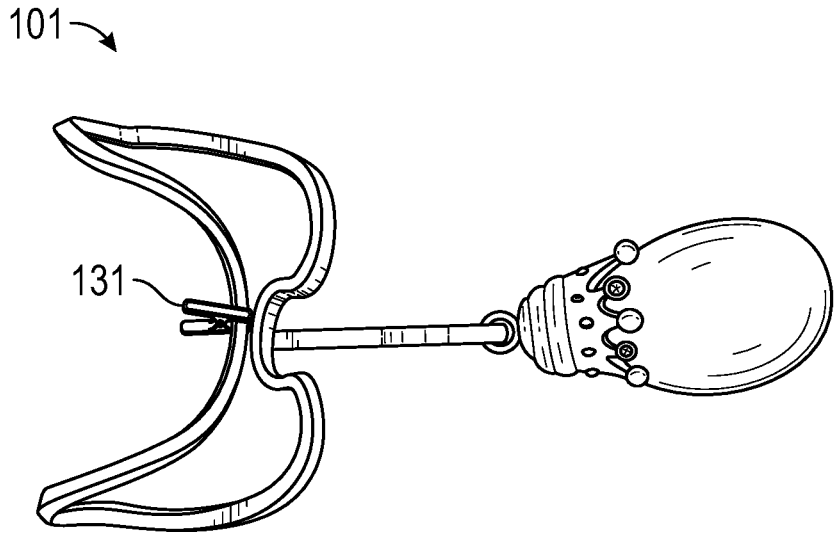
FIGS. 9-10 illustrate additional embodiments of the invention.
Figure 10:
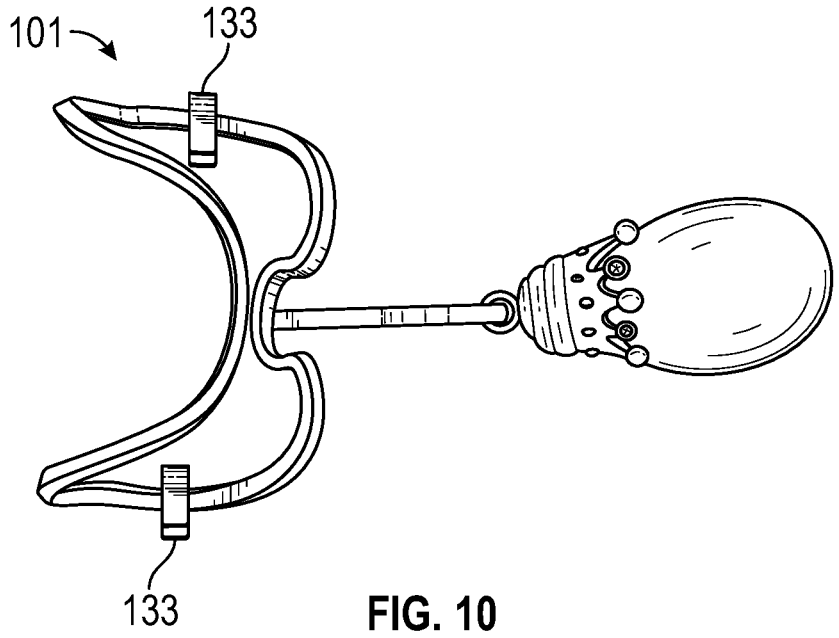

Referring now to FIGS. 9 and 10, illustrated are additional instruments for attaching and/or securing the device 101 to the necktie 121.

FIG. 9 illustrates the use of a clip 131. Clip 131 may be used to secure the device 101 to the interior of the necktie 121, such as, for example, within the knotted portion 129.

FIG. 10 illustrate the use of a plurality of clips 133. Each of clips 133 may be secure to the interior sidewalls of the knotted portion 129 of necktie 121.

It should be noted that, in accordance with the invention, the device 101 may alternatively be manufactured as a part of a necktie 121. Thus, in one embodiment, necktie 121 may be manufactured with a permanent knotted portion. Device 101 may be formed within the knotted portion of the necktie 121 and function as a scaffolding for maintaining the proper shape of the knotted portion, and additionally, may form a dimpled portion in the necktie 121. Yet further, an extension may protrude from the interior of the knotted portion and may be adapted to receive interchangeable ornamental baubles. Alternatively, the extension may include a permanent bauble.

In an embodiment of the invention, an exemplary process for utilizing the device 101 is as follows. The device 101 may be placed at the small end 135 of the necktie 121. The small end 135 is the thinner end of two tie ends in a conventional necktie. The device 101 may be placed at the small end 135 of the necktie 121 before, or during, the beginning of the knotting process.

In accordance with this embodiment, the device 101 may be slid down the necktie 121, away from the small end 135 and toward the center of the necktie 121 (e.g., toward the larger end 137). As the device 101 nears the center of unknotted necktie 121, the device 101 (via the nose 111) causes a deformation, in the form of a pinch, in the center of the necktie. The necktie 121 is then knotted. During the knotting process, the device 121 may be temporarily moved further toward the larger end 137 so as not to interfere with the knotting formation process. Once the knot is formed, the device 101 may then be moved back toward the smaller end 121, and into the knotted portion 129. The bauble 119 may protrude from the knotted portion, and the remainder of the device 101 may reside within the knotted portion.

Figure 11:
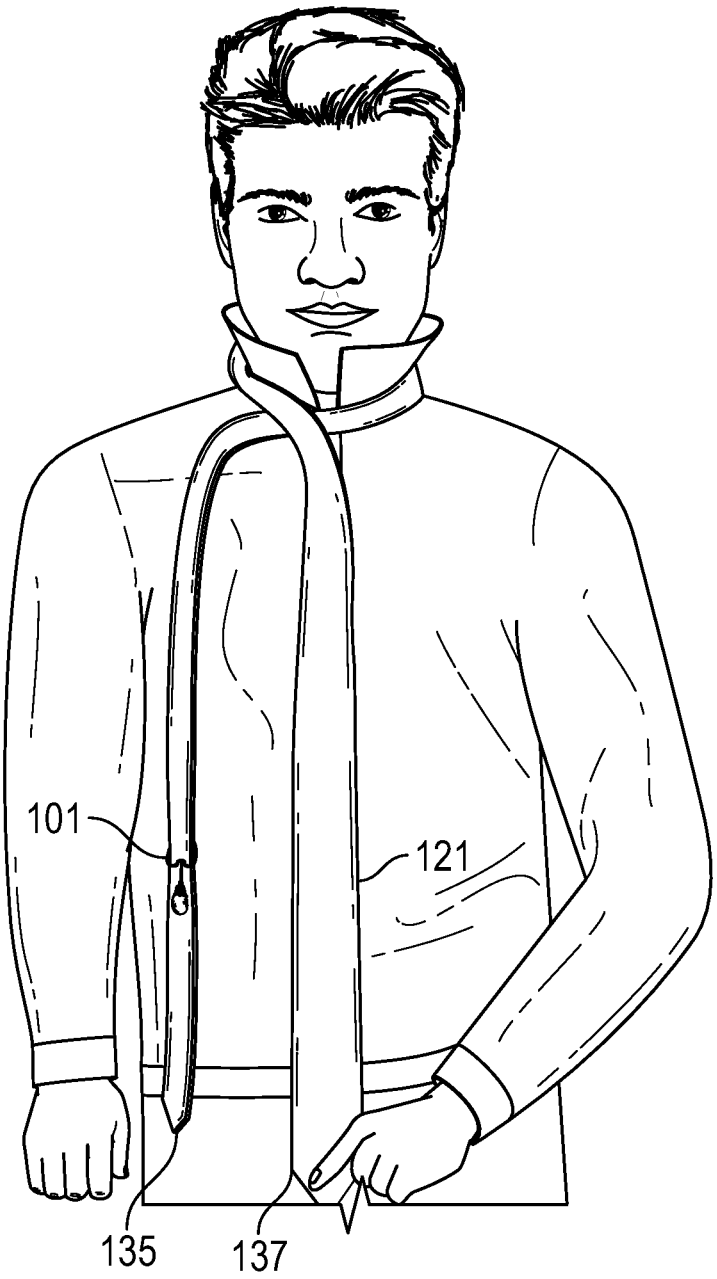
FIGS. 11-17 illustrate an exemplary method for utilizing the device.

Referring to FIG. 11, illustrated is necktie 121 before formation of the knotted portion 129 (not shown). The device 101 is shown being placed toward the small end 135 of necktie 121.

Figure 12:
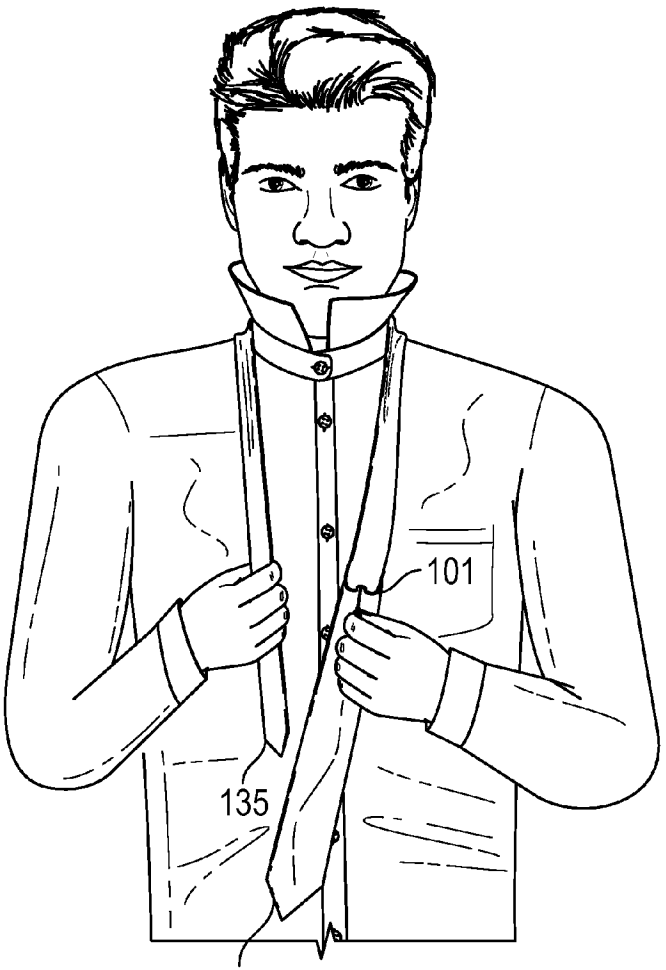

As illustrated in FIG. 12, as an individual begins the knotting formation of necktie 121, the device 101 has been moved toward the middle of necktie 121. That is, the device 101 has been moved toward the larger end 137 of necktie 121, but remains in the middle area of the necktie.

Figure 13:
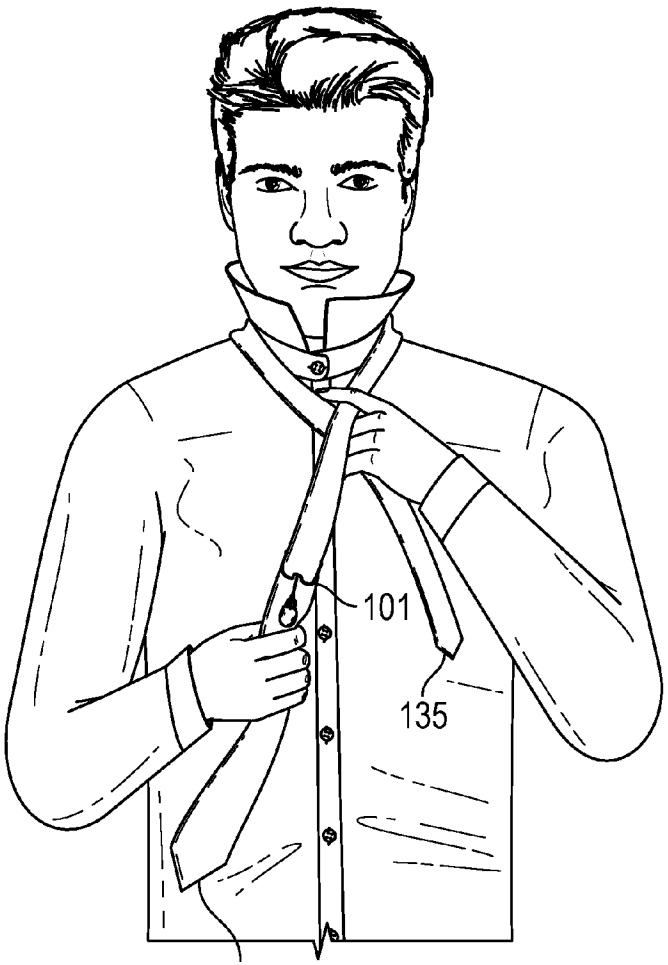
Figure 15:
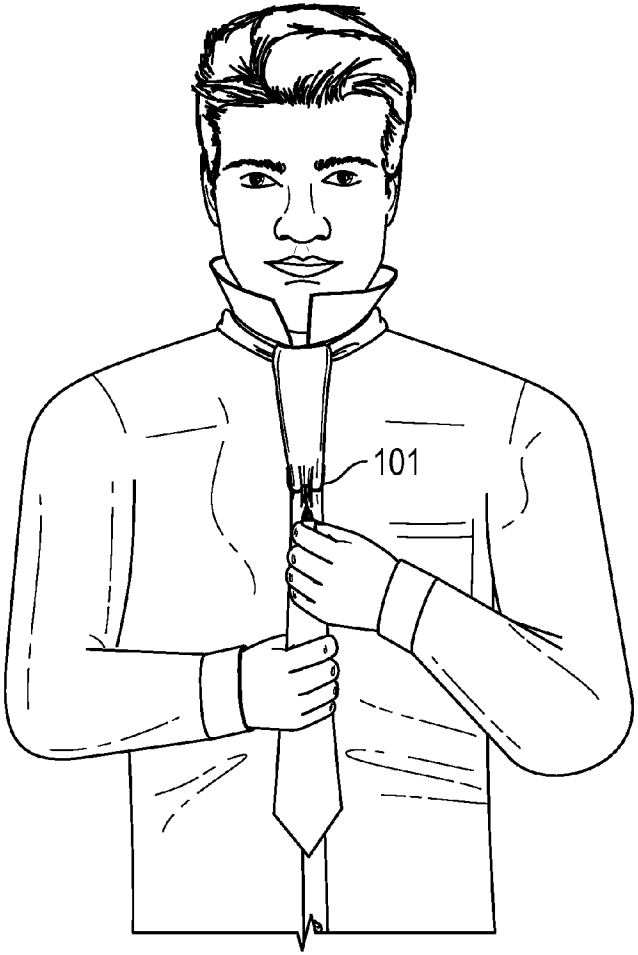
Figure 14:
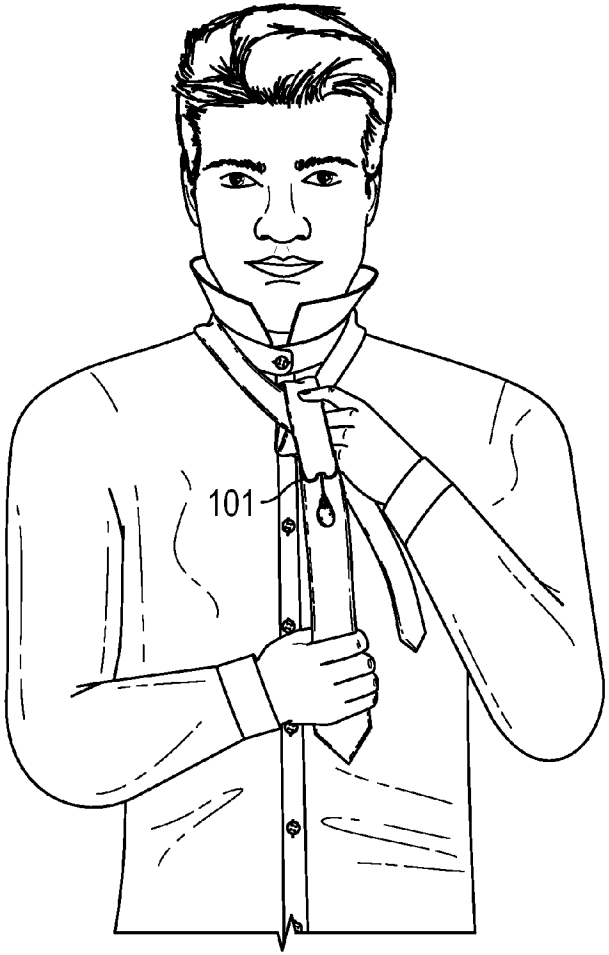
Figure 16:
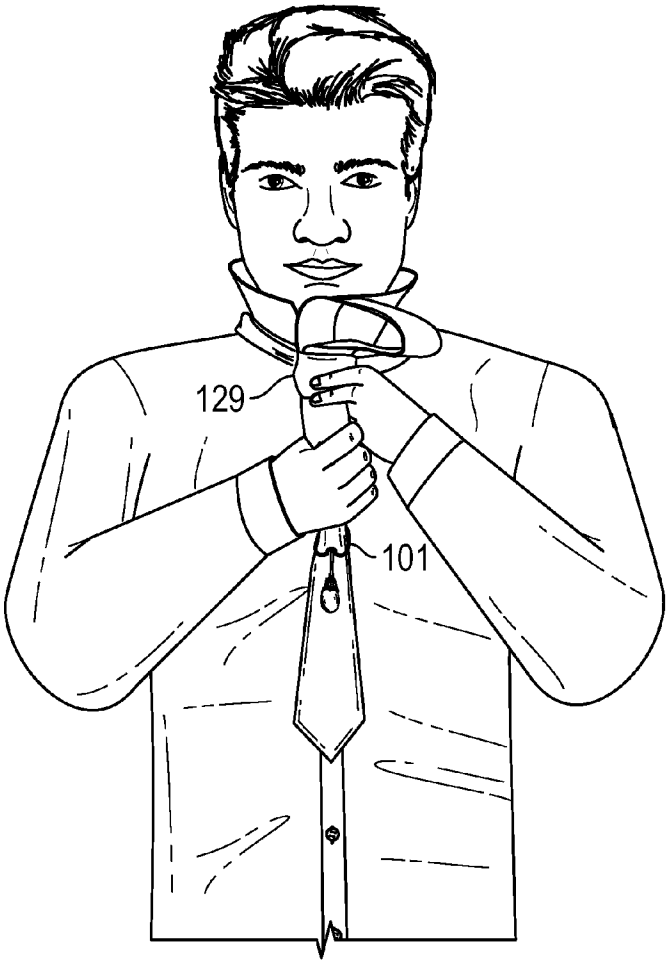

During the knotting formation, shown in FIGS. 13-14, the device 101 remains in the middle of necktie 121. Referring to FIGS. 15-16, as the knotting nears completion, the device 101 remains below the knotted portion 129 (before it is fully formed). In accordance with the invention, the user may adjust the location of device 101 to move it farther toward the larger end 137, such that the knotted portion 129 may be completed.

Figure 17:
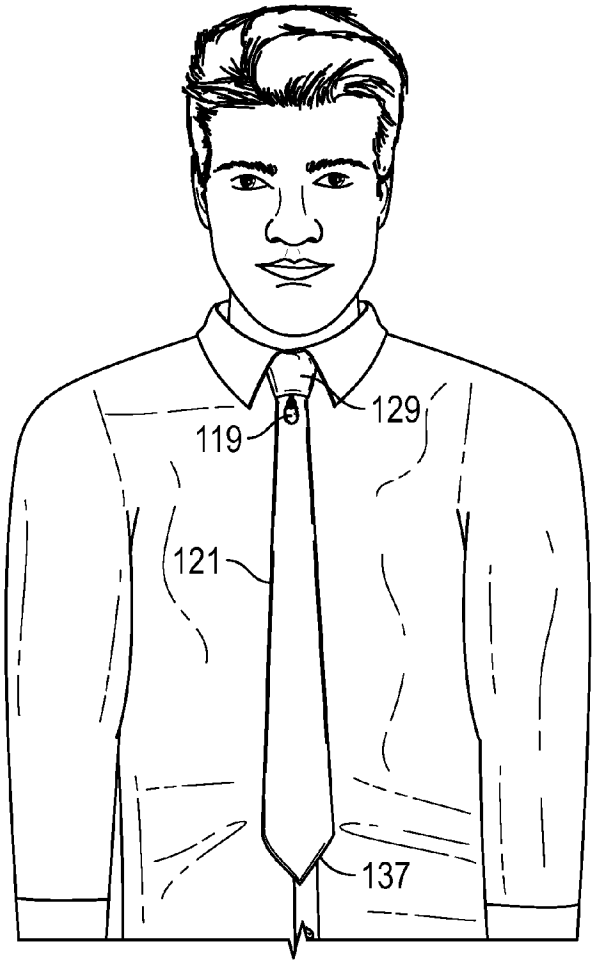

Referring to FIG. 17, after completion of the knotted portion 129, the device 101 may be moved into the knotted portion 129, residing under the knot, with the bauble 119 protruding from the knotted portion 129.

In accordance with the invention, the entirety of the device may be formed of unitary construction. In some embodiments, a substantial portion of the device, including the first and second contoured portions, the hoop, and the nose, may be formed of unitary construction. In additional embodiments, the first and second contoured portions, the hoop, the nose, and the extension may be formed of unitary construction, while the bauble of the ornamental portion may not be formed of unitary construction. In yet additional embodiments, the bauble may be removable. In yet further embodiments, the entirety of the invention, including the bauble, may be formed of unitary construction.

The device of the present invention may be used within any suitable necktie. Additionally, the device contemplates, and is adapted for use with, all suitable necktie knots, including, but not limited to the following knots: four-in-hand, half-Windsor, full-Windsor, Nicky, bowtie, kelvin, oriental, and Pratt.

The device of the present invention may be formed from any material, including any suitable metal, plastic, polymer, fiberglass, or any other suitable material. In one embodiment, the device may be formed from a malleable material, such as bendable or malleable metal or plastic. Thus, in accordance with this embodiment, the frame of the device may be adapted to change shapes as desired, such as to adapt the style of the knot.

While the present invention has been related in terms of the foregoing embodiments, those skilled in the art will recognize that the invention is not limited to the embodiments described. The present invention can be practiced with modification and alteration within the spirit and scope of the foregoing description. Thus, the description is to be regarded as illustrative instead of as restrictive on the present invention.

What is claimed is:

1. A device for perfecting a necktie knot on a necktie, comprising:

a wire structure; comprising:

a main body formed in a substantially U-shape, the main body including a first contoured portion and a second contoured portion, the first contoured portion curved at a mirror image angle relative to the second contoured portion;

a nose formed in a semi-circular shape midway between the first contoured portion and the second contoured portion; and a hoop formed in a wide bowl shave, the hoot including:

a first descending portion;

a second descending portion, the first descending portion and the second descending portion formed at mirror image angles; and an apex at the bottom of the hoop, the apex residing on a first axis and the first and second contoured portions residing on a second axis; and an ornamental portion, wherein the device is retained within the necktie knot via the nose providing a first force against a rear interior portion of the necktie knot and the hoop providing a second force against a front interior portion of the necktie knot; and wherein the nose forms a deformation within a bottom portion of the necktie.

2. The device of claim 1 wherein the first contoured portion includes a first end and a second end and the second contoured portion includes a first end and a second end.

3. The device of claim 2 further comprising:

the first end of the first contoured portion and a first end of the second contoured portion being continuous with the nose; and the second end of the first contoured portion and a second end of the second contoured portion being continuous with the hoop.

4. The device of claim 1 wherein the ornamental portion includes an extension.

5. The device of claim 4 wherein the ornamental portion extends from the nose.

6. The device of claim 4 wherein the ornamental portion includes an ornamental bauble attached to the extension.

7. The device of claim 5 wherein the bauble is attached to the extension via a ring.

8. The device of claim 5 further comprising:

the first contoured portion configured to receive a first portion of a necktie; and the second contoured portion configured to receive a second portion of the necktie.

9. The device of claim 8 wherein the nose is further configured to deform a third portion of the necktie.

10. The device of claim 8 wherein said extension is configured to descend between two portions of the necktie.

11. A device for perfecting a tie knot, comprising:

a first contoured side portion including a first end and a second end;

a second contoured side portion including a first end and a second end;

a nose;

a hoop;

an ornamental portion; and a plurality of side clips, wherein the first end of the first contoured side portion and the first end of the second contoured side portion are continuous with the nose, and wherein the device is secured to the necktie via a plurality of side clips.

12. The device of claim 11 further comprising the second end of the first contoured side portion and the second end of the second contoured side portion being continuous with the hoop.

13. The device of claim 11, wherein the nose is adapted to form a pinch within the necktie.

14. The device of claim 11, wherein the device is formed of unitary construction.

15. The device of claim 11, wherein the ornamental portion includes an ornamental extension.

16. The device of claim 15, wherein the ornamental extension extends from the nose.

17. A device for forming a tie knot, the device comprising:

a first contoured side portion residing on a first axis comprising a first end and a second end;

a second contoured side portion residing on the first axis comprising a first end and a second end;

a nose;

a hoop including an apex, the hood residing on a second axis substantially perpendicular to the first axis; and an ornamental extension extending from the nose, wherein the first end of the first contoured side portion and the first end of the second contoured side portion are continuous with the nose, and the second end of the first contoured side portion and the second end of the second contoured side portion are continuous with the hoop.

18. The device of claim 17 wherein the first contoured side portion is configured to receive a first portion of the necktie, and the second contoured side portion is configured to receive a second portion of the necktie.

19. The device of claim 18 wherein the nose is further configured to buttress a third portion of the tie.

20. The device of claim 19 wherein the hoop is configured to buttress a fourth portion of the tie, the ornamental extension further comprising a bauble descending therefrom.

* * * * *